US006453787B2

(12) United States Patent
Yamauchi

(10) Patent No.: US 6,453,787 B2
(45) **Date of Patent: *Sep. 24, 2002**

(54) DEVICE FOR REMOVING END PACKAGING FROM WEB ROLLS

(75) Inventor: Satoru Yamauchi, Nishikasugai-gun (JP)

(73) Assignee: Kabushiki Kaisha Isowa Hooperswift, Aichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,576

(22) Filed: Jun. 3, 1999

(30) Foreign Application Priority Data

Jun. 4, 1998 (JP) ..... 10-156377

(51) Int. Cl.[7] ..... B65B 69/00

(52) U.S. Cl. ..... 83/733; 83/924; 53/381.2; 414/412

(58) Field of Search ..... 53/381.2; 414/412; 83/733, 734, 410.8, 411.1, 411.3, 411.5, 425, 425.2, 427, 924

(56) References Cited

U.S. PATENT DOCUMENTS 4,158,417 A * 6/1979 Inoue ..... 83/924
4,534,151 A * 8/1985 Schneck et al. ..... 53/415
4,929,141 A * 5/1990 Keesey et al. ..... 414/412
4,997,329 A * 3/1991 Hanamoto et al. ..... 414/412
5,016,429 A 5/1991 Kubsik et al. ..... 53/381.1
5,060,456 A * 10/1991 Wehrli ..... 53/381.2
5,371,938 A * 12/1994 Martin ..... 414/412
5,752,359 A * 5/1998 Oord ..... 53/381.2

FOREIGN PATENT DOCUMENTS

| | | |
|---|---|---|
| DE | 3137899 | 4/1983 |
| GB | 2214483 | 9/1989 |
| WO | 9525040 | 9/1995 |

OTHER PUBLICATIONS

Patent Abstract of Japan, vol. 097, No. 012, corresponding to JP09–221116, Dec. 1997.

* cited by examiner

*Primary Examiner*—Allan N. Shoap
*Assistant Examiner*—Stephen Choi
(74) *Attorney, Agent, or Firm*—Darby & Darby

(57) ABSTRACT

A pair of drawing members, separated by a prescribed distance, are rotated toward each other in contact with an end packaging material covering the ends of a web wrapped on a web roll. The drawing members are brought toward one another, creating an insertion section by gathering the end packaging and separating the end packaging from the web on the web roll. A cutting member is inserted into the insertion section. The web roll is then rotated, whereby the end packaging is cut and removed from an end of a web roll without damaging the web wrapped thereon. Similar drawing members and cutting members are preferably located at each end of an end packaging removal device, thereby simultaneously removing the end packaging material from both ends of the web roll. The resulting end packaging removal device saves time and labor involved in removing end packaging from a web roll.

2 Claims, 8 Drawing Sheets

DEVICE FOR REMOVING END PACKAGING FROM WEB ROLLS

BACKGROUND OF THE INVENTION

The present invention relates to a device for removing end packaging from web rolls. More specifically, the present invention relates to a device that automatically removes end packaging material covering axial ends of a web roll.

Rolls having a hollow core wrapped with a single-piece web, e.g., long sheets of paper, film, or metal foil, or composite sheets such as laminated film, have been widely used in various fields of industry for different uses. For example, in offset rotary printing presses and letter presses, a roll (hereinafter referred to as a "web roll"), consisting of a rolled-up web to be printed upon, is mounted on a web feeding device. The web is drawn out from the feeding device into the printing press.

In order to prevent the web roll from being damaged or dirtied as it is transported from a paper plant to a printing plant, a perimeter-surface packaging material (wrapper) is wrapped around an outer perimeter surface. End packaging material covers both axial ends. When a web roll is shipped to the printing plant, both types of packaging material must be removed. Currently, a worker must manually remove the packaging material from the web roll. This is an obstacle to the implementation of labor-saving measures. Furthermore, in removing the end packaging material covering the axial ends of the web roll, the worker must slide a cutter or knife between the end packaging material and the perimeter surface packaging material to cut along the entire perimeter of the packaging material. This is a very complicated procedure. Also, the cutter or the knife can damage the web when cutting the end packaging material and the perimeter surface packaging material.

OBJECTS AND SUMMARY OF THE INVENTION

It is an object of the present invention to provide a device for removing end packaging from web rolls which overcomes the foregoing problems.

It is a further object of the present invention to automate removal of the end packaging material covering axial ends of a web roll.

It is still a further object of the present invention to provide a labor-saving device for removing end packaging material of a web roll.

Briefly stated, the present invention provides a pair of drawing members, separated by a prescribed distance, which are rotated toward each other in contact with an end packaging material covering the ends of a web wrapped on a web roll. The drawing members are brought toward one another, creating an insertion section by gathering the end packaging and separating the end packaging from the web on the web roll. A cutting member is inserted into the insertion section. The web roll is then rotated, whereby the end packaging is cut and removed from an end of a web roll without damaging the web wrapped thereon. Similar drawing members and cutting members are preferably located at each end of an end packaging removal device, thereby simultaneously removing the end packaging material from both ends of the web roll. The resulting end packaging removal device saves time and labor involved in removing end packaging from a web roll.

According to an embodiment of the present invention, there is provided a device for removing end packaging from a web roll comprising cutting means for cutting the end packaging, drawing means for creating an insertion section of the end packaging, insertion means for inserting the cutting means into the insertion section, and rotating means for rotating the web roll with the cutting means into the insertion section, whereby the rotating means begins rotation of the web roll after the cutting means is inserted into the insertion section, thereby cutting the end packaging from the web roll without damaging a web wrapped thereupon.

According to another embodiment of the present invention, there is provided a device for removing end packaging from a web roll comprising a support device rotatably supporting the web roll, the support device including means for rotating the web roll, first and second cutting units separated by a distance greater than the length ofthe web roll, first and second drawing members separated by a distance greater than the length of the web roll, the first and second drawing members moving in a first direction perpendicular to an axis of rotation of the web roll, the first and second drawing members moving in a second direction along the axis of rotation, whereby movement in the first and second directions permits the first and second drawing members to contact the end packaging material at a point on both ends of the web roll near an outer perimeter surface of the web roll, each of the first and second drawing members include first and second drawing rollers, separated by a prescribed distance, gripping the end packaging of the web roll, the first and second drawing members include means for moving the first and second drawing rollers toward each other, whereby the end packaging is gathered and separated from a web on the web roll to create an insertion section, and moving means for moving at least one of the first and second cutting units and the web roll to permit the cutting unit to cut the end packaging at the insertion section, whereby rotation of the web roll causes the first and second cutting units to cut and remove the end packaging from the web roll.

According to still another embodiment of the present invention, there is provided an apparatus for removing an end packaging from a cylindrical object comprising first and second spaced-apart drawing members, means for moving the first and second drawing members into contact with the end packaging and then moving the first and second drawing members toward each other to distort a portion of the end packaging therebetween into an outwardly projecting insertion section, a knife, means for inserting the knife into the insertion section, thereby penetrating the end packaging, and the knife being effective, when the cylindrical object is rotated therepast, to separate the end packaging from the cylindrical object.

In order to overcome the problems described above and to achieve the objects described above, the present invention provides a device for removing an end packaging material covering both axial ends of a web roll including a support device rotatably supporting the web roll, further including rotating means rotating the roll, a pair of cutting units which can be brought close together and far apart from each other along the axis of the web roll, a pair of drawing members disposed at positions facing the ends of the web roll at the cutting units which can be brought close together and far apart from each other, activating means disposed at each ofthe cutting units and having the pair of drawing members moved toward each other so that a knife insertion section is formed by drawing out the end packaging material between the drawing members and separating the end packaging material from the end of the web roll, the drawing members being in contact with the end packaging material covering the ends of the web roll, and a knife disposed on each of the cutting units capable of being projected in and recessed from the knife insertion section of the end packaging material formed by the pair of drawing members, wherein the end packaging material is cut and removed by rotating the web roll while the knife is inserted in the knife insertion section.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
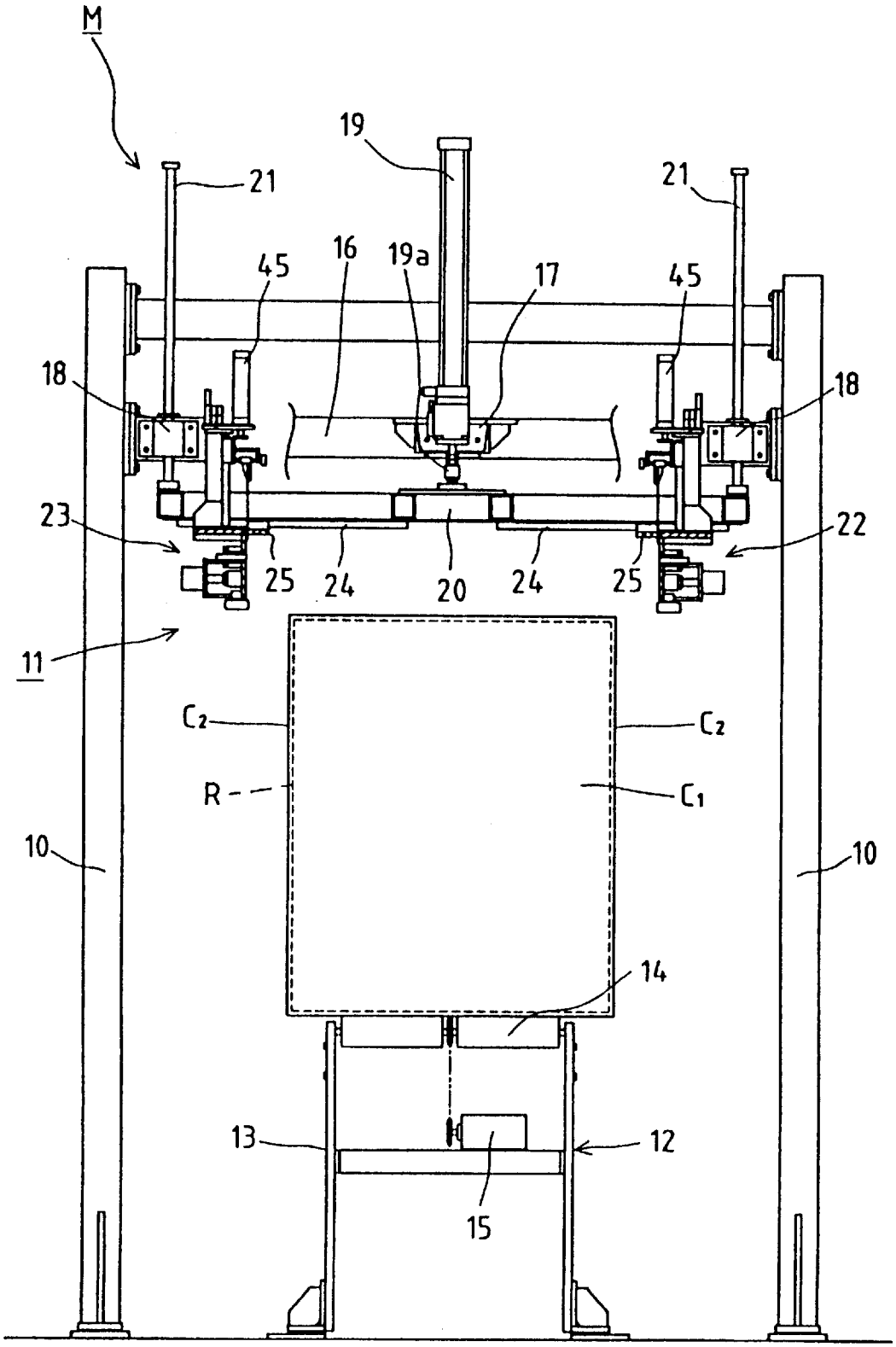
FIG. 1 is a partial front-view of a device for removing end packaging material according to an embodiment of the present invention.

The terms "lateral" and "longitudinal" are used in the following detailed description with reference to directions as shown in FIG. 1.

Referring to FIG. 1, a device M for removing end packaging material from a web roll includes a cutting device 11 positioned between a pair of frames 10. Frames 10 are separated by a prescribed lateral distance. A support device 12, installed on a mounting floor surface below cutting device 11, supports a web roll R. An outer perimeter surface of web roll R is covered with a perimeter surface packaging material $C_1$ Axial ends of web roll Rare covered with end packaging material $C_2$.

Support device 12 includes a pair of rollers 14 (only one is shown in the figure), serving as rotating means. A base 13, mounted on the installation floor surface, supports rollers 14. Rollers 14 are parallel to an axis of rotation (the lateral axis) and are longitudinally separated, i.e., separated along a direction perpendicular to an axis along which frames 10 are separated (a lateral axis). Web roll R is mounted between rollers 14 with a lateral axis of web roll R parallel to an axis of rotation of rollers 14. A rotation motor 15, serving as rotating means, is disposed on base 13. Motor 15 rotates each of rollers 14 in the same direction. When end packaging material $C_2$ is being cut away and removed, web roll R, supported by support device 12, is rotated in a prescribed direction. Cutting device 11 then cuts along an entire perimeter of end packaging material $C_2$.

A pair of longitudinally separated connecting beams 16 (only one is shown in the figure) extend between frames 10. A longitudinal center beam 17 extends at the lateral center between connecting beams 16. Longitudinal side beams 18 extend along the left and right of longitudinal center beam 17. A hydraulic lifting cylinder 19 projects from longitudinal center beam 17. A piston rod 19*a*, pointing downward from cylinder 19 toward web roll R, connects to a central section of a support frame 20 of cutting device 11. Support frame 20, having a prescribed lateral length, is positioned directly above web roll R. Activation of hydraulic lifting cylinder 19 raises and lowers support frame 20 toward and away from web roll R. Bottom ends of a pair of guide rods 21 connect to left and right ends of support frame 20. Longitudinal side beams 18 include means to permit guide rods 21 to slide up and down, allowing support frame 20 to be raised and lowered with a level orientation.

Multiple positioning rollers (not shown) are rotatably disposed on a lower surface of support frame 20. Lowering position detection sensors (not shown) detect when the positioning rollers come into contact with web roll R. As the hydraulic lifting cylinder 19 lowers support frame 20, the position detection sensors detect contact between the positioning rollers and an upper portion of web roll R. Cylinder 19 is stopped when contact is detected. When support frame 20 is in an active position (where it is lowered and has stopped), a pair of drawing rollers 32 (see FIG. 3), positioned respectively on cutting units 22 and 23, face an upper section of the ends of web roll R. Axes of rotation of the positioning rollers are perpendicular to an axis of rotation of web roll R. When end packaging material $C_2$ is being cut and removed, the positioning rollers rotate with the rotation of web roll R.

Cutting units 22 and 23, disposed on support frame 20, cut and remove end packaging material $C_2$ covering axial ends of web roll R. Since the structure of cutting units 22 and 23 are identical (symmetrical), the following description describes right cutting unit 22, toward the right side of the figure. Left cutting unit 23 has like elements assigned like numerals.

Figure 2:
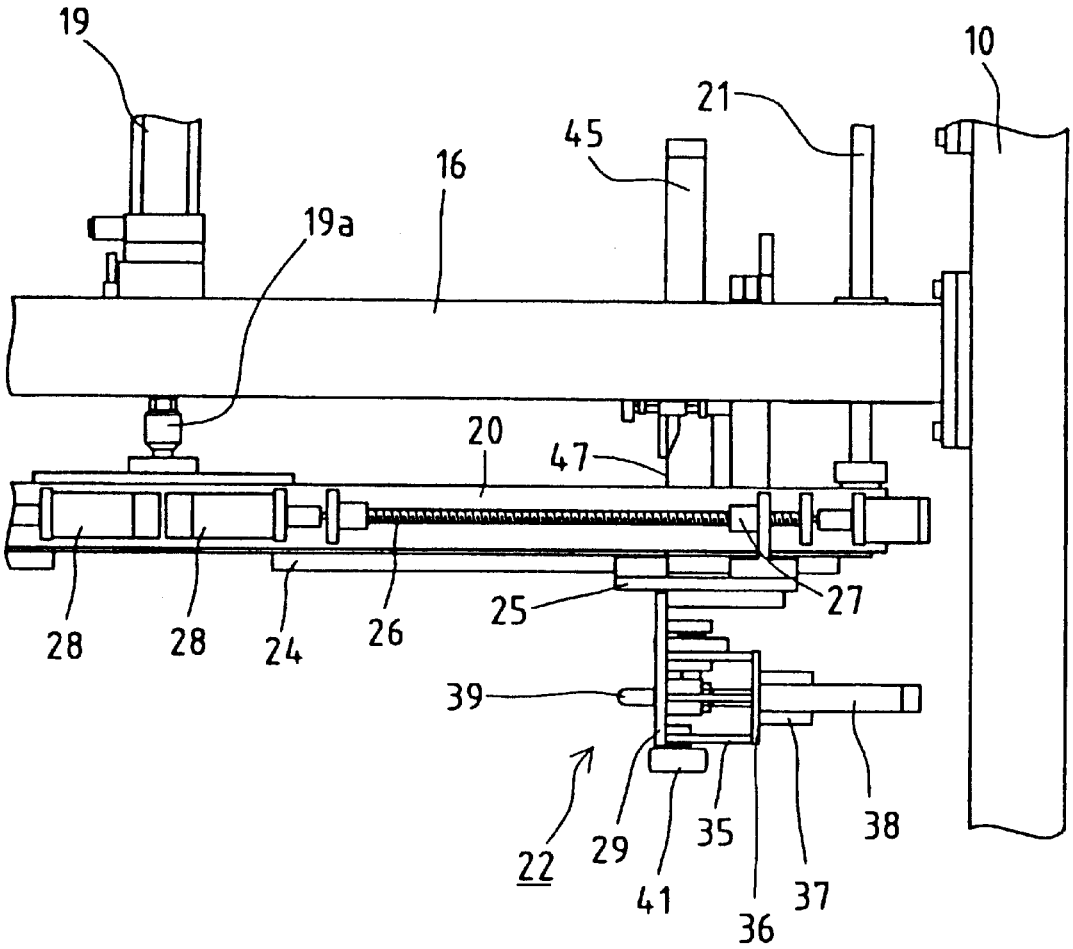
FIG. 2 is a close-up drawing of the right cutting unit of the device of FIG. 1.
Figure 6:
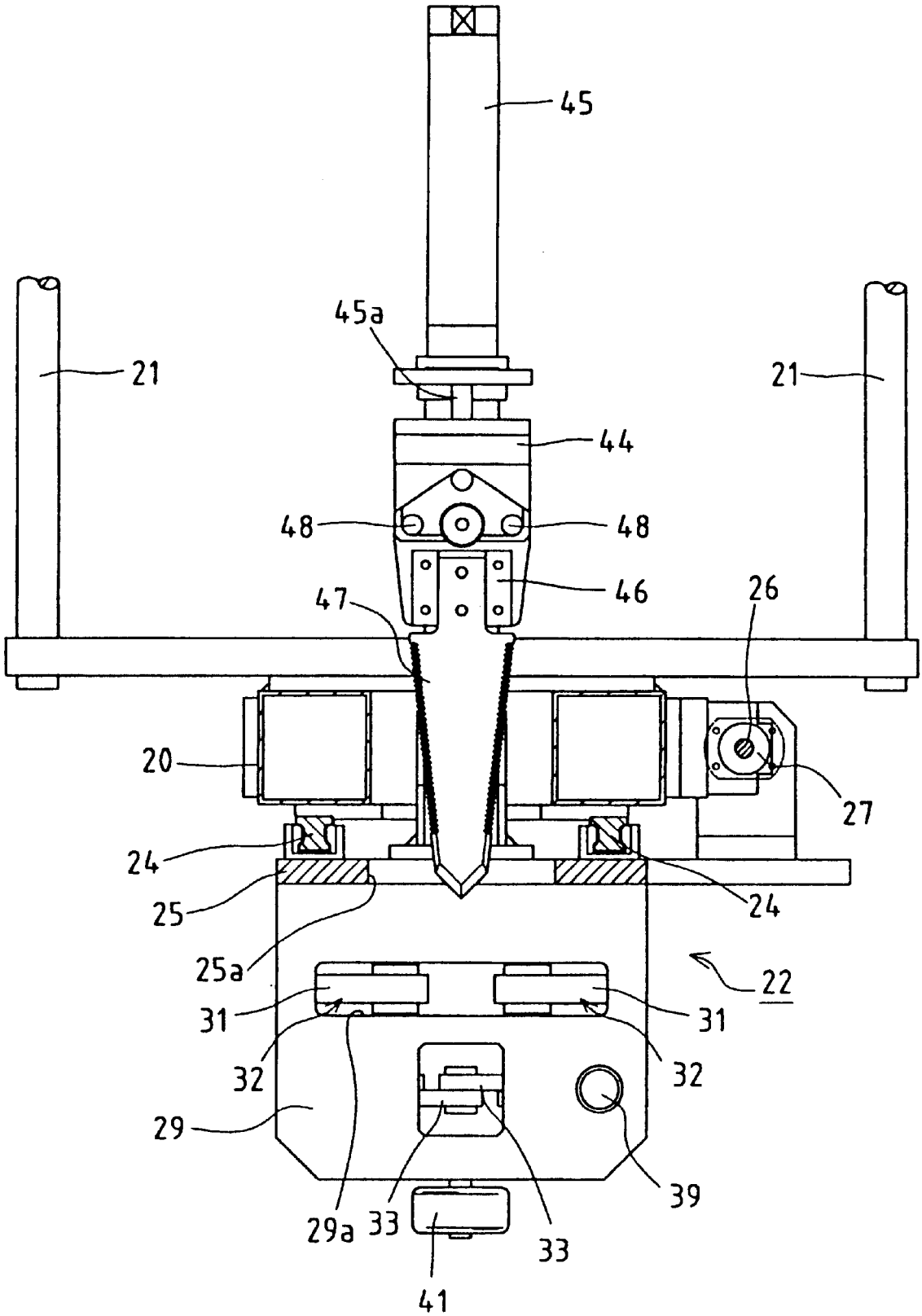
FIG. 6 is a side-view drawing of the right cutting unit of FIG. 2.

Referring to FIGS. 2 and 6, a pair of longitudinally separated guide rails 24 extend laterally over a prescribed length at a lower surface of support frame 20. A moving body 25 is slidably disposed on guide rails 24. On a front surface of support frame 20, a screw shaft 26 is rotatably disposed parallel to guide rails 24. Screw shaft 26 screws into a nut member 27. Screw shaft 26, connected to a displacement motor 28, can be rotated in either direction. Displacement motor 28 is positioned at a laterally central region of support frame 20. When displacement motor 28 rotates screw shaft 26, engagement of screw shaft 26 and nut member 27 causes moving body 25 to move laterally (along the axis of the web roll R) along guide rails 24. Displacement motors 28 of left and right cutting units 22 and 23 are activated in tandem and cutting units 22 and 23 move toward each other and apart relative to the lateral center of support frame 20.

Figure 3:
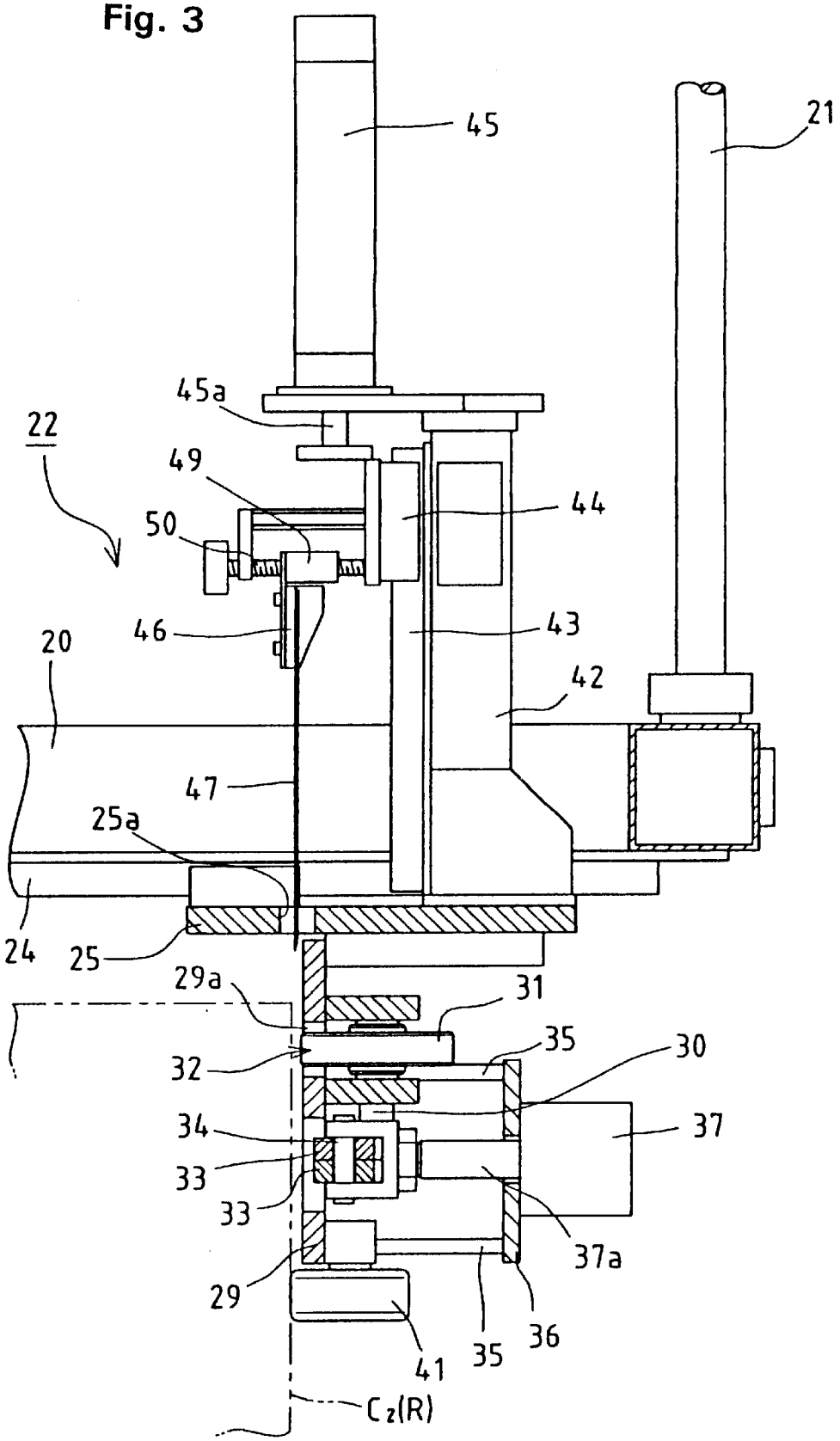
FIG. 3 is a vertical partial cross-sectional front-view of the right cutting unit of FIG. 2.
Figure 4:
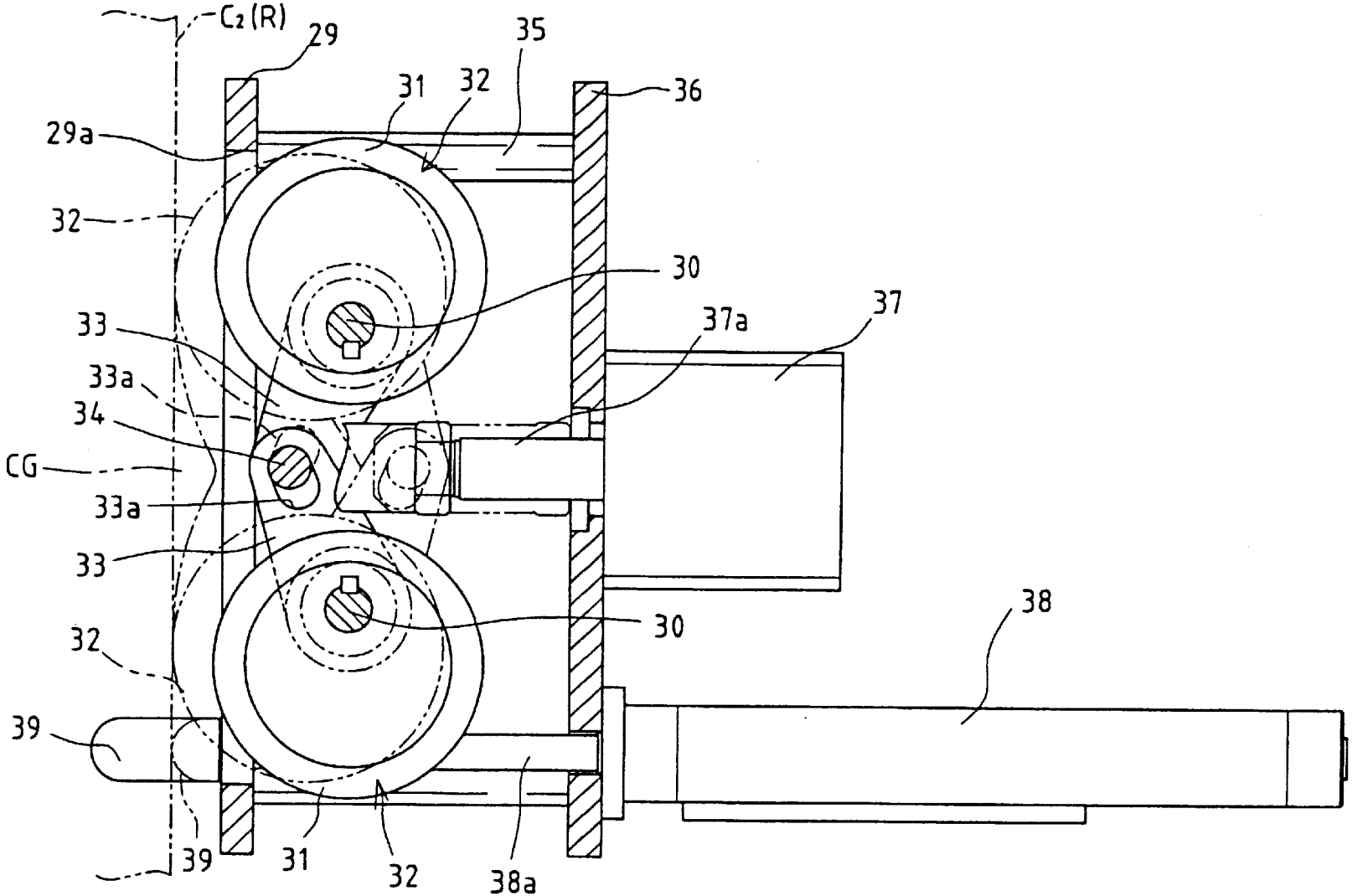
FIG. 4 is a plan-view cross-sectional drawing of a horizontal cross-section of the right cutting unit of FIG. 2.
Figure 5:
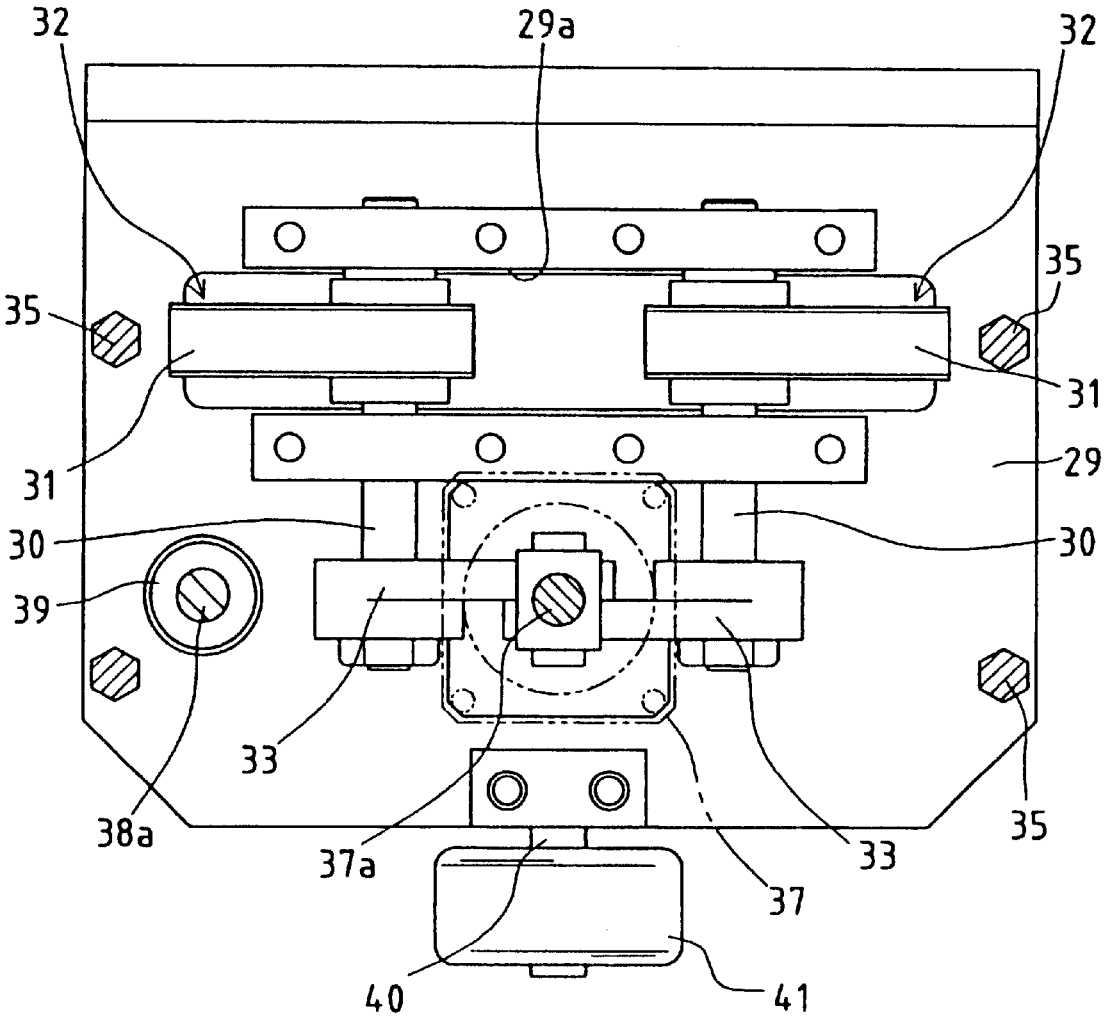
FIG. 5 is a side-view showing the position of the drawing rollers in the right cutting unit of FIG. 2.

Referring to FIGS. 3 through 5, support plate 29 projects perpendicular to a lower surface of moving body 25. An outer surface of support plate 29, away from left cutting unit 23, rotatably supports a pair of vertical active shafts 30. In each active shaft 30, drawing roller 32 is eccentrically disposed as a drawing member. Rubber rings 31, preferably having high friction coefficients, are fitted to an outer perimeter of each drawing roller 32. Support plate 29 has an opening 29*a* corresponding to the position of drawing rollers 32. Drawing rollers 32 are projected and retracted from opening 29*a*.

Each end of a pair of linking members 33 connects to a lower end of each active shaft 30. A slot 33*a* is located near the other end of each linking member 33. A pin 34 is inserted through slots 33*a* of both linking members 33. Pin 34 is positioned on a piston rod 37*a* of a hydraulic drawing cylinder 37. An attachment plate 36, connected via a plurality of connecting members 35 to an outer side of support plate 29, supports hydraulic drawing cylinder 37. When hydraulic drawing cylinder 37 operates, each linking member 33 pivots around pin 34 in opposite directions within a prescribed angular range. Active shafts 30, which pivot integrally with each linking member 33, move each drawing roller 32 in an arcuate path between a standby position (indicated by the solid line in FIG. 4), where they are moved away from each other and recessed inwardly (toward attachment plate 36) from opening 29*a*, and a drawn position (indicated by the dotted lines in FIG. 4), where they are drawn toward each other and project outward (toward left cutting unit 23) from opening 29*a*. As drawing rollers 32 move from a standby position to a drawn position, rollers 32 contact the end a packaging material $C_2$ of web roll R.

Figure 7A:
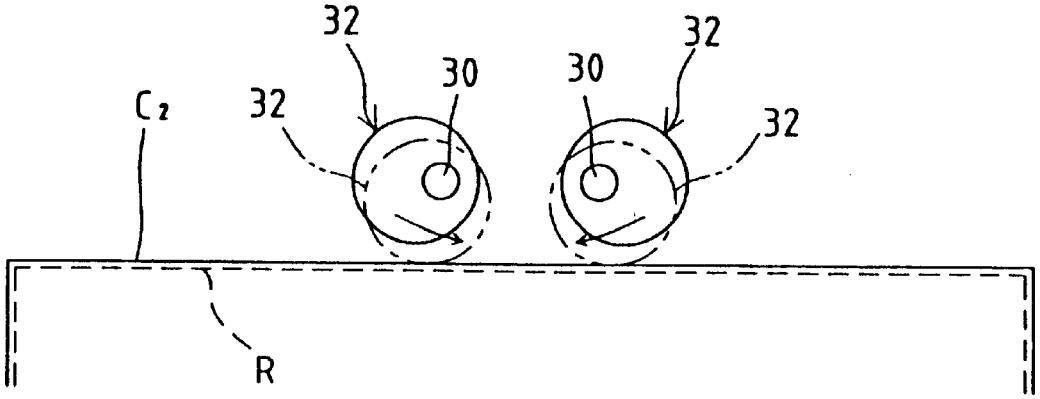
FIG. 7 illustrates the process of forming a knife insertion section using a pair of drawing rollers.
Figure 7B:
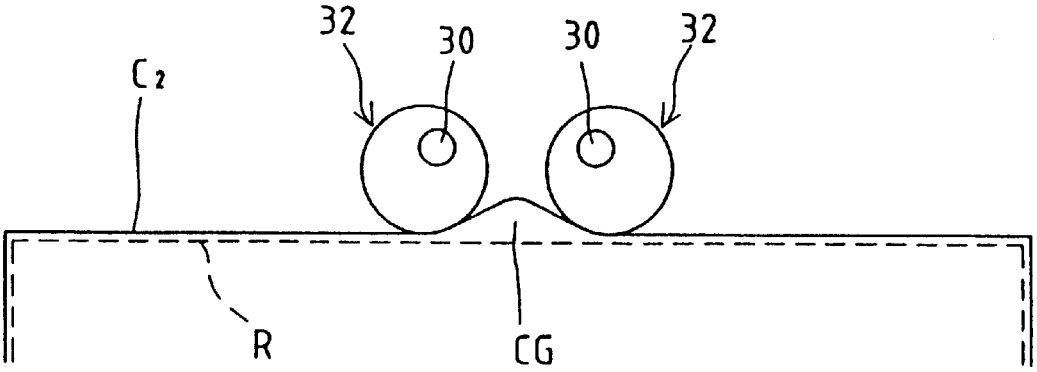

Referring to FIGS. 7*a* and 7*b*, a drawing operation from either side causes end packaging material $C_2$ to separate from ends of web roll R to form an insertion section CG. In one embodiment of the present invention, active shafts 30, linking members 33, pins 34, and hydraulic drawing cylinder 37 serve as means for activating drawing rollers 32.

Referring back to FIG. 4, a hydraulic detection cylinder 38 is horizontally positioned on attachment plate 36. An end detection bar 39 connects to a piston rod 38*a* of cylinder 38. End detection bar 39 laterally inserts through support plate 29. Hydraulic detection cylinder 38 maintains a prescribed pressure on end detection bar 39, causing end detection bar 39 to extend inward (toward web roll R) from support plate 29. When right cutting unit 22 is moved by displacement motor 28, detection bar 39 contacts the end of web roll R. Hydraulic detection cylinder 38 permits detection bar 39 to be recessed toward attachment plate 36. A reed switch (not shown), detects when end detection bar 39 is recessed to a prescribed position, stopping further movement of cutting unit 22 by displacement motor 28. The reed switch can be set up to detect the displacement position of end detection bar 39, the displacement position of piston rod 38*a* of hydraulic detection cylinder 38, or the like.

Referring to FIG. 5, a support roller 41 is rotatably disposed on a lower end of support plate 29 with a vertical shaft 40. When the end detection bar 39 is recessed to a prescribed position by contact with the end of web roll R, the movement of right cutting unit 22 is stopped. Support roller 41 contacts the end of web roll R, rotating in tandem with the rotation of web roll R during cutting and removal of end packaging material $C_2$.

Referring to FIGS. 3 and 6, a support shaft 42 projects from an upper surface of moving body 25. A vertically extending guide rail 43, at an inner vertical surface of support shaft 42, faces left cutting unit 23. A lifting member 44 slides on guide rail 43. A hydraulic knife cylinder 45, serving as displacement means, is vertically positioned at an upper end of support shaft 42. A piston rod 45*a*, pointing downward from hydraulic knife cylinder 45, connects to lifting member 44. Activation of cylinder 45 causes lifting member 44 to move vertically along guide rail 43. A knife 47 is removably disposed on lifting member 44 with an attachment tool 46. Knife 47 projects downward by a prescribed length from an inner position above support plate 29. Knife 47 is a double-edged knife with a pointed lower end and a continuous blade. When knife 47 is lowered with hydraulic knife cylinder 45, knife 47 inserts into insertion section CG (see FIG. 7*b*) of end packaging material $C_2$. Moving body 25 has an opening 25*a* allowing vertical movement of knife 47.

Attachment tool 46 moves laterally along guide rods 48 on lifting member 44. An adjustment screw 50, rotatably disposed on lifting member 44, engages with a nut member 49, disposed on attachment tool 46. Rotation of adjustment screw 50 laterally displaces attachment tool 46 and knife 47, allowing for the accurate insertion of knife 47 into insertion section CG of end packaging material $C_2$, without damaging the web of web roll R.

When support frame 20 is positioned with the positioning roller (not shown) contacting an upper section of web roll R, hydraulic knife cylinder 45 moves knife 47 between an upper standby position, where knife 47 does not obstruct web roll R, and a lower projected position, where a prescribed length of knife 47 is inserted into insertion section CG.

Figure 8:
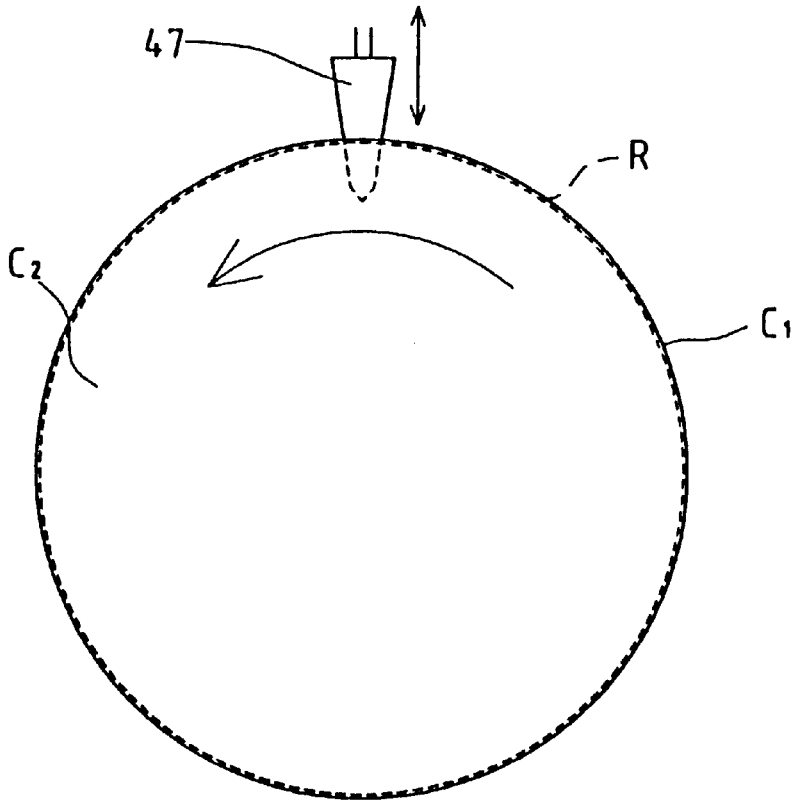
FIG. 8 illustrates how the knife cuts the end packaging material.
Figure 9:
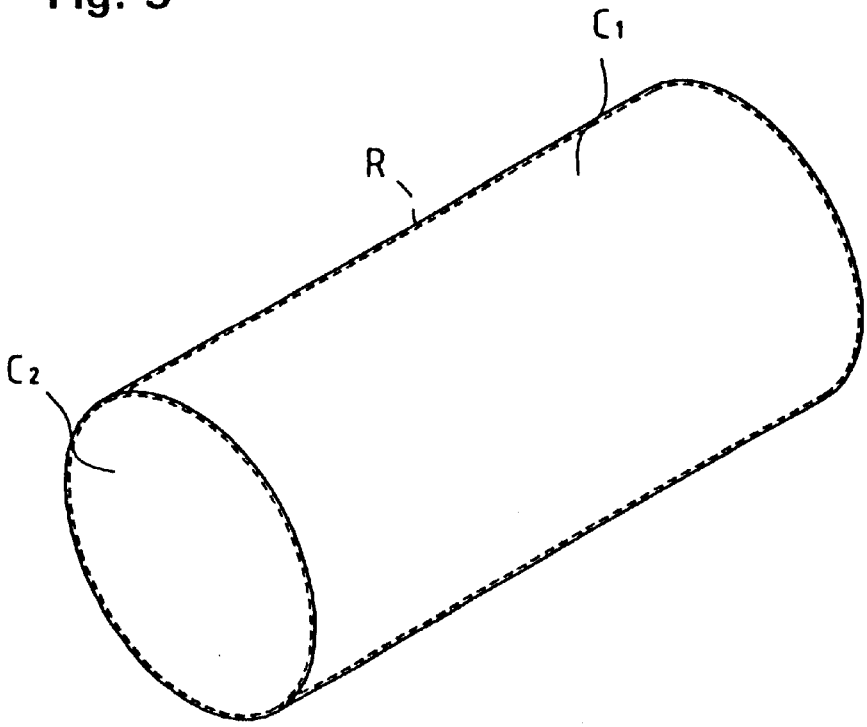
FIG. 9 is a perspective drawing of a web roll covered by packaging material.

Referring to FIGS. 6 and 8, in a preferred embodiment of the present invention, hydraulic knife cylinder 45 activates to reciprocate knife 47 once inserted into insertion section CG. The reciprocal movement of knife 47 is along a prescribed stroke between a projected position and a reciprocating position above the projected position where knife 47 remains engaged with insertion section CG. The vertical motion of knife 47 allows end packaging material $C_2$ to be reliably cut. A reed switch (not shown in the figures), on hydraulic knife cylinder 45, detects the position of piston rod 45*a* when piston rod 45*a* is in a standby position, a projected position, and a reciprocating position.

The following is a description of the use of device M for removing end packaging material according to the above embodiment.

Referring to FIG. 1, cutting units 22 and 23 are disposed at a standby position, where cutting units 22 and 23 are separated by a prescribed distance greater than a radius of a web roll R. Knife 47 is positioned at a upper standby position. First, web roll R is mounted on rotating rollers 14 disposed on base 13 of support device 12. When device M is activated, hydraulic lifting cylinder 19 activates piston rod 19*a*, lowering support frame 20 in a level orientation guided by guide rods 21. Next, a lowering position detection sensor (not shown) detects when the positioning rollers (not shown) disposed at a lower surface of support frame 20 contact an upper section of web roll R. Hydraulic lifting cylinder 19 halts. Support frame 20 is now positioned at an active position. While hydraulic lifting cylinder 19 moves cutting device 11 toward web roll R, cutting units 22 and 23 are positioned outward from axial ends of web roll R so that cutting units 22 and 23 do not obstruct the downward movement of support frame 20.

Displacement motors 28 of cutting units 22 and 23 rotate in an appropriate direction. Engagement between screw shaft 26 and nut member 27 causes cutting units 22 and 23 to approach each other. Since cutting units 22 and 23 operate in the same manner, the description below describe only right cutting us unit 22.

As right cutting unit 22 approaches an end of web roll R, end detection bar 39 contacts the end of web roll R, pushing back end detection bar 39. A reed switch then detects the recession of piston rod 38*a* of hydraulic detection cylinder 38 to a prescribed position. Displacement motor 30 is then halted.

Referring to FIG. 3, the end of web roll R contacts support roller 41, leaving a small gap between web roll R and support plate 29. Next, hydraulic drawing cylinder 37 activates in a prescribed direction, displacing drawing roller 32 from a standby position to a drawn position with linking members 33.

Referring to FIGS. 7*a*, 7*b*, and 8, drawing rollers 32, starting at the standby position, move along an arcuate path, approaching each other while approaching the end of web roll R. During this process, drawing rollers 32 contact end packaging material $C_2$ covering the end of web roll R, drawing end packaging material $C_2$ toward drawing rollers 32. End packaging material C2 drawn between drawing rollers 32 is separated outward from web roll R, forming a roughly triangular knife insertion section CG. When hydraulic drawing cylinder 37 stops, hydraulic knife cylinder 45 activates to lower knife 47 from a standby position to a projected position. Knife 47 inserts from above into knife insertion section CG of end packaging material $C_2$ formed by drawing rollers 32. Thus, knife 47 is now inserted between the end of web roll R and end packaging material $C_2$. At this point, there is adequate space at knife insertion section CG between the end of web roll R and end packaging material $C_2$. This adequate space prevents knife 47 from damaging the web on web roll R. Once the insertion of knife 47 is complete, hydraulic drawing cylinder 37 operates in reverse, restoring drawing rollers 32 from the drawing position to the standby position.

When the reed switch detects that knife 47 is lowered to its projected position, hydraulic knife cylinder 45 reverses, moving knife 47 vertically between a projected position and a reciprocating position along a prescribed stroke. Rotation motor 15 of support device 12 rotates, rotating web roll R. The rotation of web roll R while knife 47 reciprocates along a prescribed stroke, cuts end packaging material $C_2$ along the entire perimeter of web roll R. End packaging material $C_2$ that has been cut away is ejected outside device M through a chute (not shown in the figures).

Rotation motor 15 is stopped when web roll R has made at least one rotation. Each of the different members are then brought back to their respective initial standby positions, thus completing the cutting and removing of end packaging material $C_2$.

With end packaging material removal device M according to this embodiment, end packaging material $C_2$ covering axial ends of web roll R is automatically cut and removed, resulting in saved labor. When knife 47 is inserted into end packaging material $C_2$, adequate space is provided between the end of web roll R and end packaging material $C_2$, preventing knife 47 from damaging the web on web roll R. Furthermore, since end packaging material $C_2$ covering both ends of web roll R is cut and removed simultaneously, the time required for the operation is reduced.

The present invention is not restricted to the embodiment described above. Other structures may be implemented. For example, instead of the combination of a screw shaft and a nut member, the displacement mechanism for moving body 25 can include a rack and pinion mechanism or a chain and sprocket mechanism. Also, in the embodiment described above, end packaging material $C_2$ is cut by moving knife 47 up and down while web roll R rotates. However, it is also possible to have end packaging material $C_2$ cut by simply rotating web roll R while knife 47 is kept at the projected position. In this case, the blade of knife 47 is preferably linear and is not required to have a double edge.

In the embodiment described above, cutting units 22 and 23 are moved close to and away from web roll R supported by support device 12. However, it is also possible to use an opposite arrangement. A liftable table can be installed on the base a support device so that web roll R is lifted by a lifting device. The lifting device can use any conventional lifting means, such as a parallel linking mechanism. Web roll R is rotatably supported between a pair of rotating rollers disposed on the liftable table. Through the support device, web roll R is brought close to and away from a cutting device, which is disposed at a fixed position. It is also possible to have the cutting device move close to and away from web roll R, or to have web roll R move laterally close to or away from the cutting device.

In the embodiment described above, drawing rollers 32 form an arcuate path. However, it is also possible to have drawing rollers 31 move along a linear path to approach each other while contacting end packaging material $C_2$. In this alternate embodiment, the drawing members can be of any suitable shape, such as rectangles, triangles, and the like. For the activating means of the drawing members, a combination of a screw shaft and a nut member or a rack and pinion mechanism can be used as appropriate. It is also possible to have each drawing member directly activated by a hydraulic cylinder.

As described above, the device for removing end packaging material from web rolls according to the present invention allows end packaging material covering axial ends of a web roll to be automatically removed, thus saving labor and providing for automation. Furthermore, since the end packaging material is removed simultaneously from both ends, the time required for the operation is reduced while the amount of work required by the workers is decreased. Also, when the knife is inserted in the end packaging material, an adequate space is created between the end of the web roll and the end packaging material, preventing the web from being damaged by the knife. Since the web roll is rotated while the knife is moved in a reciprocating manner along an appropriate stroke, the end packaging material is cut reliably.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A device for removing an end section from a web roll packaging enclosing a periphery and opposite ends of said web roll, said device comprising:

means for supporting said web roll for rotation about an axis of rotation;

a cutting unit including a knife;

a pair of drawing rollers, said drawing rollers being supportable proximal an end face of said web roll for movement from a position wherein said drawing rollers are laterally remote said web roll end face to a position wherein said drawing rollers contact the packaging end section covering said web roll end face proximal an outer perimeter surface of said web roll; and means for counter rotating said drawing rollers when said drawing rollers are in contact with said packaging end section to draw material of said packaging end section away from said web roll end to define a knife insertion section therewith, said cutting unit being operable to extend said knife into said insertion section of said packaging end section and reciprocate said knife while in said insertion section, so that with concurrent rotation of said web roll about said axis of rotation, said packaging end section is cut away from the packaging enclosing said web roll periphery.

2. The device according to claim 1, wherein said knife is a double edge knife.

* * * * *